United States Patent [19]

O'Donnell

[11] 4,004,545

[45] Jan. 25, 1977

[54] BOUNDARY MARKER

[75] Inventor: John Francis O'Donnell, Peoria, Ill.

[73] Assignee: G.L.P. Company, Peoria, Ill.

[22] Filed: Feb. 2, 1976

[21] Appl. No.: 654,161

Related U.S. Application Data

[63] Continuation-in-part of Ser. No. 560,187, March 20, 1975, abandoned.

[52] U.S. Cl. ..... 116/63 P

[51] Int. Cl.² ..... E01F 9/10

[58] Field of Search ..... 116/63 R, 63 P, 173, 116/DIG. 16; 40/125 N, 125 J, 125 H, 10 C, 10 D, 317; 52/727, 103; 272/78; 404/10, 11

[56] References Cited

UNITED STATES PATENTS

| | | | |
|---|---|---|---|
| 470,873 | 3/1892 | Chapman | 40/317 |
| 2,625,760 | 1/1953 | Cleal | 40/10 C |
| 3,279,133 | 10/1966 | De Korte | 52/103 |
| 3,478,714 | 11/1969 | Keats | 116/63 P |
| 3,566,000 | 2/1971 | Maurer | 52/727 |
| 3,740,881 | 6/1973 | Finger | 40/125 H |
| 3,851,616 | 12/1974 | Brown | 116/63 R |
| 3,874,103 | 4/1975 | Muta | 40/125 H |

FOREIGN PATENTS OR APPLICATIONS

| | | | |
|---|---|---|---|
| 642,468 | 1/1963 | Belgium | 116/63 P |
| 1,482,473 | 4/1967 | France | 116/63 P |

OTHER PUBLICATIONS

The Encyclopedia of Chemistry, Hamdel et al., 1973, pp. 876–878.

*Primary Examiner*—S. Clement Swisher
*Assistant Examiner*—Denis E. Corr
*Attorney, Agent, or Firm*—David H. Hill

[57] ABSTRACT

A boundary marker or delineator is disclosed comprising an elongate hollow cylindrical pole member normally held in an upright position with respect to a base member by means of a solid flexible support member. The cylindrical pole member is filled with a solidified foam and closed by opposed end caps held in place by a centrally-disposed rigid rod member threadedly connected to each. When utilized as a path delineator for moving vehicles, the boundary marker is capable of withstanding impact forces upon being struck and crushing forces upon being run over by vehicles of all types.

15 Claims, 4 Drawing Figures

BOUNDARY MARKER

This application constitutes a continuation-in-part of copending application Ser. No. 560,187, filed Mar. 20, 1975, now abandoned by John Francis O'Donnell, for "Guide Lane Post".

FIELD OF THE INVENTION

This invention pertains generally to boundary markers, and more particularly to boundary markers or path delineators for vehicular traffic, requiring that the marker or delineator be capable of withstanding the forces experienced upon being struck by a moving vehicle and also be capable of withstanding the crushing forces experienced by a prone marker when being run over by a vehicle tire.

BACKGROUND OF THE INVENTION

It is oftentimes necessary, or at least desirable, to provide various readily visible guides to direct traffic flow or establish traffic patterns. Such is the case, for example, where it is desired that vehicular traffic follow a particular route, such as being directed into a proper lane of a multilane highway. While such routing might be marked by painted lines or the like on the highway itself, it has been found that this is often not satisfactory in accomplishing the intended end.

It has also been suggested that posts embedded in the highway might also be utilized to route vehicular traffic, but such posts, if rigid, have been found to require seemingly continuous maintenance and replacement due to breakage primarily from vehicle contact.

To avoid breakage, it has also previously been suggested that boundary markers and other signal devices could either be made of a flexible material or at least have a capability of being deflected. An example of the flexible type marker is shown in U.S. Pat. No. 3,371,647, while examples of other deflectable markers or signal devices are shown in U.S. Pat. Nos. 3,485,201; 3,478,714; 3,279,133; 3,851,616; 1,939,968; 3,705,566 and 3,792,679 and Belgian Pat. No. 642,468 and French Pat. No. 1,482,473.

Boundary markers and signal devices of the foregoing type have not proved, however, to be completely successful in satisfying at least some needs, due to, among other reasons, failure to provide satisfactory visible indications both during the day and at night, breakage despite their ability to be deflected, being adversely affected by weather and other environmental conditions and/or difficulty in maintenance.

SUMMARY OF THE INVENTION

The device of the present invention constitutes a vastly improved boundary marker, providing superior performance and longer life even when subjected to the rigors of modern high-speed vehicular traffic. More specifically, the present invention provides a boundary marker capable of being struck repeatedly by vehicles moving at the highest legal speeds, as well as being rolled over by the tires of trucks of the heaviest legal limits, all without significant deterioration of the appearance or actual mechanical integrity of the device. Further, this invention provides a boundary marker which may be utilized in all weather conditions and which affords superior visibility over extended periods of time.

It is accordingly an object of the present invention to provide an improved boundary marker or the like which is substantially indestructible even when subjected to relatively severe mechanical abuse.

It is a more specific object of this invention to provide a boundary marker or the like which retains its structural integrity even when repeatedly struck by vehicles moving at highway speeds and when repeatedly rolled over by the tires of the heaviest trucks on the roads.

A further object is to provide a boundary marker or the like which is adapted to be deflected from a normal upright position to a horizontal position upon being struck by a vehicle, to be run over by the vehicle tires and to return to the normal upright position as the vehicle moves on, all without mechanical damage to the marker.

Another object of the present invention is to provide a boundary marker or the like having light-reflecting portions thereon the reflectivity of which is not impaired by repeated impact or roll-over by various elements of vehicles passing thereover.

BRIEF DESCRIPTION OF THE DRAWINGS

With the above and other objects and considerations in mind, the invention itself will now be described in connection with a preferred embodiment thereof, given by way of example and not of limitation, in connection with the accompanying drawings, in which.

DESCRIPTION OF THE INVENTION

Figure 1:
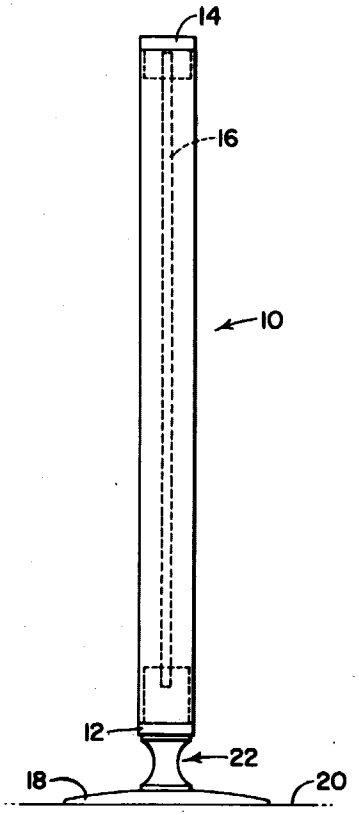
FIG. 1 is an elevation view of the apparatus of the present invention in its normal upstanding position.

FIG. 1 shows the apparatus of the present invention in its normal upstanding position and comprising an elongate hollow cylindrical pole member 10 having first and second end caps 12 and 14, respectively, which serve to close the respective ends of the cylindrical pole member 10.

A substantially rigid rod member 16 is positioned within the cylindrical pole member 10 and is connected at its opposite ends to the respective end caps 12 and 14 in a manner that will be described in further detail in connection with the later figures of the drawings.

A base member 18 is adapted to be attached to a fixed support surface 20, which may be the pavement surface of a roadway or the like, the ground itself or any other fixed support surface to which a boundary marker is to be attached.

Figure 4:
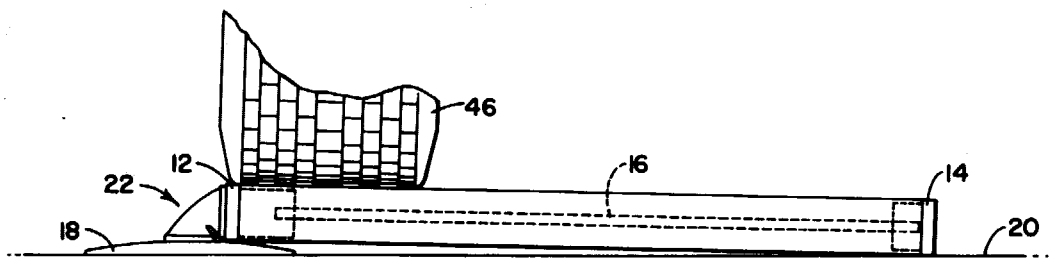
FIG. 4 is an elevation view of the apparatus of FIG. 1 shown deflected from the position of FIG. 1.

Interconnecting the base member 18 and the first end cap 12 of the cylindrical pole member 10 is a substantially solid unitary flexible support member 22, which may be of rubber or the like. The support member 22 is adapted to flex when the cylindrical pole member 10 is subjected to impact forces, enabling the entire cylindrical pole member 10 to be deflected through substantially ninety degrees, as shown in FIG. 4. As seen in that figure, the cylindrical pole member 10 remains substantially rigid, and the flexing of the entire assembly is made possible by the resilience of the flexible support member 22.

Figure 2:
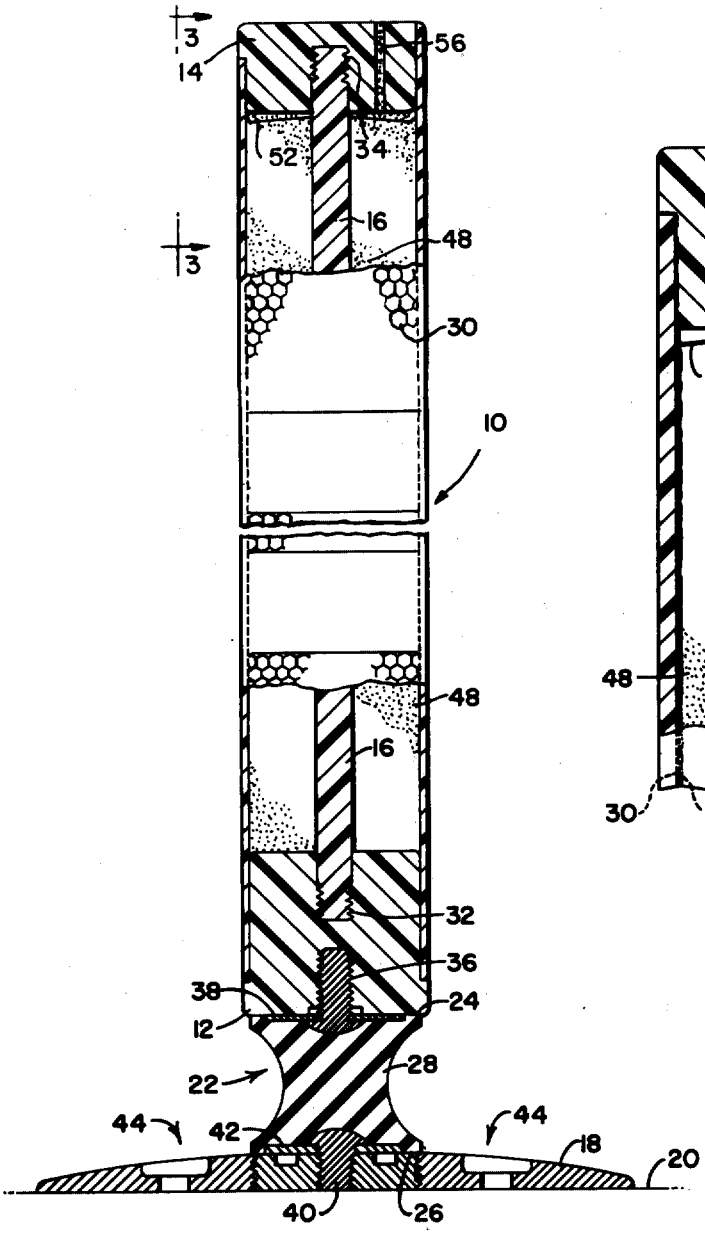
FIG. 2 is an elevation view similar to FIG. 1 but in partial vertical section.

The overall configuration of the support member 22 is generally cylindrical, including first and second circular end faces 24 and 26, respectively, and a surface of revolution 28 therebetween, as may be seen in FIG. 2. In the preferred embodiment shown in these drawings, the surface of revolution 28 is concave, and the flexible support member 22 is, accordingly, of generally hour-glass configuration. Where the boundary marker of the present invention is utilized in ambient conditions of relatively high wind velocity, it is sometimes desirable to employ a support member 22 of overall cylindrical configuration in which the surface of revolution 28 is a cylindrical surface having linear lengthwise elements, as opposed to the concave surface of revolution 28 shown in the drawings herein. Obviously, the fully cylindrical configuration of the support member 22 provides an additional element of stiffness resisting deflection of the pole member 10, thus providing better performance in a windy setting.

In connection with boundary markers, traffic delineators and the like known and utilized prior to the present invention, it has been common to also utilize a reflective member, such as reflective tape or the like, positioned as desired on the upstanding pole member. In this manner, the boundary markers of the prior art were rendered more visible at night, since the reflective member would reflect the light of vehicle headlamps and render the boundary marker more visible to an approaching vehicle. However, the reflective members of the markers or delineators of the prior art were positioned at the external surface of the device, one common method of providing the reflective surface being simply the addition of reflective tape to the external surface of the upstanding pole. Unfortunately, such tapes and other external reflective surface members suffer considerable wear and actual destruction upon repeated impact by passing vehicles, thus seriously impairing the visibility of the prior art devices.

In sharp contrast to the structures of the prior art, the light-reflecting member 30 is positioned just inside the hollow cylindrical pole member 10, the latter being substantially transparent to light rays and preferably comprising a polycarbonate tube. Thus, the outer reflective surface of the light-reflecting member 30 receives and reflects light through the polycarbonate pole member 10 but is protected from scuffing, scraping and actual removal by virtue of the protective casing comprising the polycarbonate pole member itself. Exhaustive experimental testing has been performed in connection with boundary marker devices constructed in accordance with this teaching of the present invention, with no adverse effects upon the light-reflecting members therein.

As may be clearly seen in FIG. 2, the centrally located substantially rigid rod member 16 is threaded at its respective extremities 32 and 34, these threaded extremities being received in threaded apertures in the respective end caps 12 and 14. In order to lend mechanical strength to this pair of threaded interconnections, the axial length of threaded engagement is somewhat less than the penetration of the extremity of the rod member into the cooperating aperture in the respective end cap. In other words, the threaded portion of the rod extremity does not extend from the tip of the rod to the internal face of the end cap, and the rod member 16 is, accordingly, stronger at the point of egress from the end cap, where resistance to flexing is needed. Additionally, it has been discovered that the structural integrity of the apparatus at this point is enhanced by ensuring that the portion of the end cap just outboard of the rod extremity is of a dimension substantially equal to the diameter of the rod. That is to say, the thickness of end cap 14 above the upper extremity 34 of rod 16 is substantially equal to the diameter of the rod, and the transverse web of the end cap 12 just below the lower extremity 32 of rod 16 is, likewise, of a dimension (axially) substantially equal to the diameter of the rod 16.

A threaded connector member 36 and an associated disc or washer 38 is suitable adhered, as by an epoxy adhesive or the like, to the upper circular face 24 of the support member 22. Similarly, a threaded connector member 40 and an associated washer 42 are affixed to the lower circular face 26 of the support member 22. By means of the threaded connector members 36 and 40, as well as cooperating threaded apertures in, respectively, end cap 12 and base member 18, the three main elements of the apparatus of the present invention, viz., the base member 18, the support member 22 and the pole member 10, may be easily assembled together or taken apart. It will be understood that base member 18 may be affixed to the support surface 20 by any suitable means, such as by an epoxy adhesive or by means of suitable connectors which may be positioned in and extend through the recessed apertures 44 in base member 18.

The ability of the road marker of the present invention to withstand extreme crushing forces such as can be applied by a tire 46 of a passing vehicle (as seen in FIG. 4) depends in part upon the fact that the respective end caps 12 and 14 extend a distance into the respective end of the hollow cylindrical pole member 10; obviously, transverse or radial strength is provided at each ends by this construction. Along the length of the pole member 10 intermediate the two end caps the ability to withstand crushing radial forces is derived from the fact that the hollow cylindrical pole member 10 is filled with a solidified from 48, indicated most clearly in FIG. 3. The solid foam 48 is contained within a thin plastic bag 50 which extends substantially the entire length of the hollow pole member 10 and which is just inside the light-reflecting member 30 which, in turn, is just inside the hollow polycarbonate tube constituting the pole member 10. The solidified foam fill 48 is preferably of a density of substantially 6 pounds per cubic foot, and with this foam fill experimental models of the boundary marker in accordance with the teachings of the present invention have withstood 9,000 pounds pressure per square inch intermediate the ends thereof without being crushed or exhibiting any structural damage.

Figure 3:
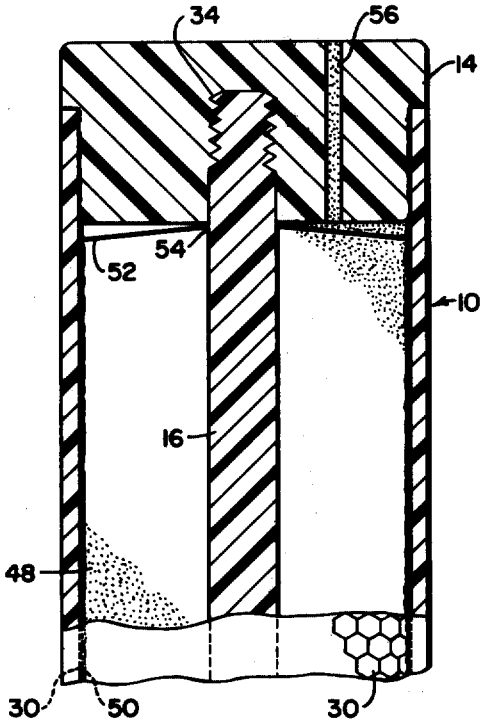
FIG. 3 is an enlarged partial vertical section of a portion of the apparatus as seen in FIG. 2.

In the assembly of the internal parts of the elongate pole member 10, the bottom end cap 12 is positioned in place as seen in FIG. 2, with the rod 16 in threaded engagement with the end cap 12 and, accordingly, being centrally located within the hollow cylindrical member 10. The thin plastic bag 50 is positioned adjacent the inside surface of the light-reflecting member 30, and the foam in liquid form is introduced into the interior of the bag. A transverse disc member 52 of cardboard or the like may be positioned as shown in FIG. 3, the central aperture 54 therein fitting around the upper end of the central rod 16 to position the latter and hold it in place while the upper end cap 14, which may be serrated to aid assembly, is threaded onto the upper end of the rod 16 to close the assembly.

Other means of centering the rod, such as pins on the upper end cap extension, may also be utilized. A small elongate weep hole 56 is provided in the end cap 14, and as the liquid foam cures, it expands to fill the void within the cylindrical pole member 10 and, the proper amount of liquid foam having been introduced, expands up into the weep hole 56 and seals the same upon solidifying. Obviously, the purpose of the weep hole 56 is to permit the air in the interior of the hollow member 10 to escape as the foam expands and solidifies.

Referring again to FIG. 4, it will be seen that by virtue of the low profile configuration or relative thinness of the base member 18 the bottom face 26 of the flexible support member 22 is, in use, very close to the fixed support surface 20. Further, by virtue of the relative dimensions of the axial length of the support member 22 and the diameter of at least the upper face 24 thereof, when the apparatus is deflected substantially 90° from its normal position of FIG. 1 to the position shown in FIG. 4, the entire assembly lies very close to the fixed support surface 20 and is supported thereby and by the upper face of the base member 18. As a result, the force of a tire 46 is unable to produce any significant flexing of the elongate member. The low profile of the entire assembly, in fact, when in the position shown in FIG. 4 is emphasized by the fact that an edge portion of the upper face 24 of the support member 22 is substantially contiguous with a corresponding edge portion of the lower face 26 thereof.

The invention has been described above in considerable detail, and with particular reference to its application to the field of road markers and the like. However, it will be obvious to those skilled in the art that the apparatus of the present invention will find utility in other analogous applications, and, further, variations in the structural details described above may be made within the teaching of the invention. For example, the light-reflecting member 30 may comprise areas of different reflectivity, as indicated generally in FIG. 2 herein, to provide any desired design. Hence, the invention is not to be considered as being limited to the particular details given, nor to the specific application to which reference has been made during the description of the apparatus, except insofar as may be required by the scope of the appended claims.

What is claimed is:

1. A boundary marker, comprising a base member adapted to be attached to a fixed support surface, a substantially rigid elongate hollow cylindrical pole member having first and second end caps adapted to close the respective ends of said cylindrical pole member, a substantially rigid rod member within said cylindrical pole member and interconnecting said first and second end caps, said cylindrical pole member being filled with a solidified foam between said end caps and around said rod member, and a solid unitary flexible support member interconnecting said base member and said first end cap.

2. A boundary marker in accordance with claim 1, wherein said cylindrical pole member is substantially transparent, and including a light-reflecting member positioned adjacent the inner surface of said cylindrical pole member.

3. A boundary marker in accordance with claim 2, wherein said cylindrical pole is a polycarbonate member.

4. A boundary marker in accordance with claim 2, wherein said light-reflecting member is cylindrical and coaxial with said cylindrical pole member.

5. A boundary marker in accordance with claim 4, wherein the outer surface of said light-reflecting member comprises portions of respectively different reflectivity.

6. A boundary marker in accordance with claim 1, wherein said rod member is threadedly engaged at its respective ends with said first and second end caps.

7. A boundary marker in accordance with claim 6, and including a transverse disc member positioned within said cylindrical tube at a position remote from said first end cap and having a central aperture through which said rod member extends, whereby the latter is centrally positioned within said cylindrical pole member to facilitate the threaded engagement of said second end cap with said rod member.

8. A boundary marker in accordance with claim 6, wherein each end of said rod member extends into a respective one of said end caps a distance greater than the length of the threaded engagement therebetween, said threaded engagement including the extremities of said rod member.

9. A boundary marker in accordance with claim 1, wherein said end caps each extend into said cylindrical pole member and provide radial support therefor.

10. A boundary marker in accordance with claim 1, wherein said solid unitary support member is substantially cylindrical in configuration, having first and second circular end faces and a surface of revolution therebetween, and including a threaded connecting member affixed to each of said end faces for engagement with cooperating threaded connector portions of said first end cap and said base member, respectively, to facilitate assembly and disassembly.

11. A boundary marker in accordance with claim 10, wherein said surface of revolution is concave.

12. A boundary marker in accordance with claim 10, wherein the length of said solid support member relative to the diameter of said first end face thereof is such that when said support member is flexed substantially 90 degrees in a plane through the axis thereof an edge portion of said first end face in said plane is substantially contiguous with a corresponding edge portion of said second end face in said plane.

13. A boundary marker in accordance with claim 1, wherein said base member comprises a thin disc-like mounting plate.

14. A boundary marker in accordance with claim 1, wherein the density of said solidified foam is substantially 6 pounds per cubic foot.

15. A device to provide guidance to motorists on a roadway, said device comprising:

a base adapted to be secured to the surface of a roadway;

a first rigid annular plate adapted to engage and be retained at said base;

a polycarbonate tube having a radius substantially equal to that of said first rigid annular plate;

a plurality of cylinders within said tube, said cylinders having indicia thereon for day and night viewing through said polycarbonate tube;

polycarbonate plugs to seal said tube with said cylinders therebetween;

a second rigid annular plate having a radius substantially equal to that of said first annular plate and attached to said tube at one end thereof so that said tube when in normal position is substantially vertical; and a substantially cylindrical rubber cushion having a radius substantially equal to that of said plates at the ends of said cushion and tapered inwardly at the central portion thereof, said rubber cushion being bonded at opposite sides to said first and second annular plates whereby deflection of said tube from its normal vertical position upon application of an external force thereto causes relative movement between said annular plates to distort said rubber cushion and create a restoring force therein, said restoring force causing said tube to assume its normal vertical position upon removal of an applied deflecting, external force.

* * * * *